United States Patent [19]

Murakami

[11] Patent Number: 4,641,622

[45] Date of Patent: Feb. 10, 1987

[54] APPARATUS FOR THROTTLE VALVE CONTROL

[75] Inventor: Terukiyo Murakami, Yokosuka, Japan

[73] Assignee: Nissan Motor Company, Limited, Yokohama, Japan

[21] Appl. No.: 747,177

[22] Filed: Jun. 21, 1985

[30] Foreign Application Priority Data

Jun. 22, 1984 [JP] Japan ..... 59-127351

[51] Int. Cl.[4] ..... F02M 51/00

[52] U.S. Cl. ..... 123/479; 123/585

[58] Field of Search ..... 123/479, 585–589

[56] References Cited

U.S. PATENT DOCUMENTS 4,453,514 6/1984 Martinsons et al. ..... 123/585

4,531,490 7/1985 Kishi et al. ..... 123/479

FOREIGN PATENT DOCUMENTS 58-15734 1/1983 Japan ..... 123/479

2013837 2/1983 United Kingdom ..... 123/479

*Primary Examiner*—William A. Cuchlinski, Jr.

*Attorney, Agent, or Firm*—Schwartz, Jeffery, Schwaab, Mack, Blumenthal & Evans

[57] ABSTRACT

An apparatus responsive to a change in the position of an accelerator pedal for controlling movement of a throttle valve situated within an induction passage. The induction passage has an auxiliary passage bypassing the throttle valve. A control valve is situated for movement within the auxiliary passage for controlling air flow through the auxiliary passage. The apparatus includes a control circuit which forces the throttle valve to move to its closed position and at the same time moves the control valve to permit air flow through the auxiliary passage when a failure occurs in the operation of the control circuit.

6 Claims, 7 Drawing Figures

APPARATUS FOR THROTTLE VALVE CONTROL

BACKGROUND OF THE INVENTION

This invention relates to an apparatus for controlling movement of a throttle valve in response to a change in the position of an accelerator pedal.

In order to meter the amount of air to an internal combustion engine, a variable positionable throttle valve is situated within the induction passage of the engine. Normally, a mechanical link mechanism is provided to couple the throttle valve to an accelerator pedal in a manner to move the throttle valve in response to movement of the accelerator pedal. In order to improve the responsiveness of the movement of the throttle valve with respect to the movement of the accelerator pedal, it has been proposed to substitute an electrical servo control system for the mechanical link mechanism. Such an electrical servo control system includes a potentiometer which converts the movement of the accelerator pedal into a corresponding electric signal which is electrically processed to drive an actuator which thereby moves the throttle valve to a position corresponding to the new position of the accelerator pedal. If the control system is subject to failure resulting in improper throttle valve control, however, the vehicle occupant will be exposed to serious danger. This is true particularly when the throttle valve is retained at its open position.

In order to eliminate the problem attendant on the use of an electrical servo control system, it may be considered to provide a return spring effective to return the throttle valve to its closed position when the actuator is placed out of operation in the even of failure of the control system. However, this raises another problem in that the operator cannot drive the automotive vehicle to a place for repair.

Therefore, the present invention provides an improved throttle valve control apparatus which permits an operator to drive the automotive vehicle to a place for repair with the throttle valve being held at its closed position.

SUMMPARY OF THE INVENTION

There is provided, in accordance with the present invention, an apparatus for use with an internal combustion engine having an accelerator pedal and a throttle valve situated within an induction passage for controlling movement of the throttle valve in response to a change in the position of the accelerator pedal. The induction passage has an auxiliary passage bypassing the throttle valve. The flow of air through the auxiliary passage is controlled by a control valve which is movable within the auxiliary passage. The apparatus also includes a signal source for generating an electrical signal indicative of the position of the accelerator pedal, a control circuit operable to determine a value corresponding to a setting of the position of the throttle valve in response to the accelerator pedal position indicative signal, and a throttle actuator connected to the control circuit for moving the throttle valve to the determined setting. The control circuit includes means for forcing the throttle actuator to close the throttle valve and moving the control valve to permit air flow through the auxiliary passage when a failure occurs in the operation of the control circuit.

BRIEF DESCRIPTION OF THE DRAWINGS

This invention will be described in greater detail by reference to the following description taken in connection with the accompanying drawings, in which like reference numerals refer to the same or corresponding parts, and wherein.

DETAILED DESCRIPTION OF THE PREFERRED EMBODIMENTS

Figure 1:
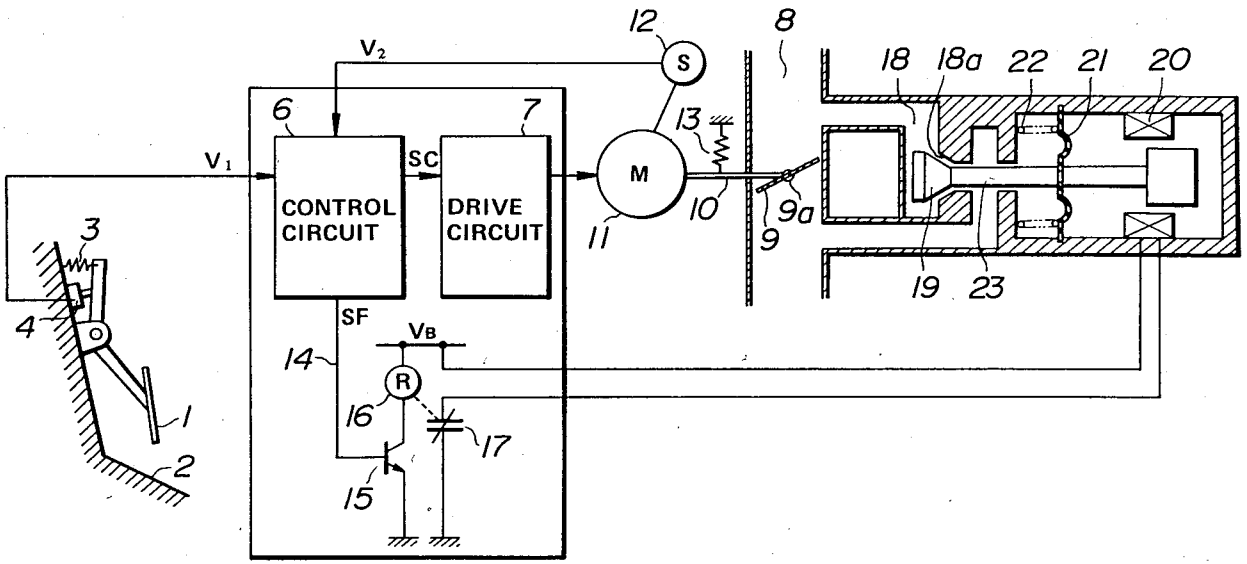
FIG. 1 is a block diagram showing one embodiment of a throttle valve control apparatus made in accordance with the present invention.

With reference to the drawings and in particular to FIG. 1, there is shown a schematic block diagram of an automobile throttle valve control system embodying the present invention. In FIG. 1, the reference numeral 1 designates an accelerator pedal which is pivoted on an automobile floor panel 2. A return spring 3 is placed between the accelerator pedal 1 and the floor panel 2 to urge the accelerator pedal 1 to its fully released position. An accelerator pedal position sensor 4, mounted on the floor panel 2, generates an analog signal V1 correspoding to the amount of depression of an accelerator pedal 1. The accelerator pedal position sensor 4 includes a potentiometer connected between a voltage source and electrical ground. The resistance of the potentiometer is a function of the extent to which the accelerator pedal 1 is depressed. The wiper arm of the potentiometer is operatively connected to the accelerator pedal 1 to change the resistance value of the potentiometer as the accelerator pedal moves between its fully released and depressed positions.

A variable positionable throttle valve 9, mounted as for rotation with a throttle shaft 9*a*, is situated within an induction passage 8 and effective for controlling the flow of air to the engine. A bi-directional control motor 11 has a motor shaft 10 which is drivingly coupled to the throttle shaft 9*a*. A return spring 13 is provided to urge the motor shaft 10*a* in a direction closing the throttle valve 9. The control motor functions to vary the position of the throttle valve in a manner as described later. It is to be noted that a clutch may be used to couple the throttle shaft 9*a* and the motor shaft 10 if desired in which case the return spring 13 may be modified to urge the throttle shaft 9*a* in a direction closing the throttle valve 9. A throttle valve position sensor 12, associated with the control motor 11, generates an analog signal V2 corresponding to the degree of opening of the throttle valve 9 in terms of the angular position of the control motor 11. The throttle valve position sensor 12 may include a potentiometer which has a wiper arm drivingly connected to the motor shaft. In addition, the throttle valve position sensor may include a potentiometer which has a wiper arm drivingly connected to the throttle shaft for generating a voltage signal corresponding to the degree of opening of the throttle valve.

The induction passage 8 has an auxiliary air passage 18 which acts as a bypass for the throttle valve 9. A control valve 19 is positioned in the bypass passage 18 and in cooperation with a port 18*a* formed in the bypass passage 18 to define an annular orifice or throat. The control valve 19 is movable to vary the area of opening of the throat so as to control the amount of air flow through the bypass passage 18. The control valve 19 is secured at one end of a plunger 23 which is movable by a solenoid 20. A compression spring 22 urges a diaphragm 21 which, in turn, urges the plunger 23 in a direction causing the control valve 19 to close the port 18*a* of the bypass passage 18. When the solenoid 20 is energized, the plunger 23 moves the control valve 19 in a direction increasing the opening area of the throat against the resilient force of the spring 22 to permit air flow through the bypass passage 18. The control valve 19 closes the port 18*a* to interrupt the air flow through the bypass passage 18 when the solenoid 20 is deenergized.

The solenoid 20 is connected at its one terminal to a voltage source VB and at an another terminal thereof to electrical ground through a relay controlled switch 17. The relay controlled switch 17 is controlled by a relay coil 16 which is connected at its one terminal to the voltage source VB at an another terminal thereof to electrical ground through the emitter-collector circuit of a transistor 15. The transistor 15 is turned on and off on command from a control circuit 6 as will be described in detail. When the transistor 15 is in its conduction state, the relay coil 16 is energized to turn the relay controlled switch 17 off so as to deenergize the solenoid 20. When the transistor 15 is in its non-conductive state, the relay coil 16 is deenergized to turn the relay controlled switch 17 on so as to energize the solenoid 20.

The sensor signals V1 and V2 are applied to a control circuit 6 which determines the required new setting, at a given time, of the throttle valve position. The actual setting of the throttle valve 9 is accomplished with the control motor 11 and its drive circuit 7. The control circuit 6 produces a control signal SC to the drive circuit 7 for controlling the direction and degree of motion of a bi-directional motor 11. The control circuit 6 detects a failure in the operation of the control circuit 6. In the presence of a failure in the control circuit 6, the control circuit interrupts the application of the control signal SC to the drive circuit 7 so as to return the throttle valve 9 to its fully closed position under the resilient force of the return spring 13 and also produces a failure signal SF on the line 14 to switch the transistor 15 off. The signal, which appears on the line 14, is normally at a high level to keep the transistor 15 in its conduction state, and it changes to a low level to change the transistor 15 into its non-conductive state in the event of failure of the control circuit 6. When the transistor 15 is in its non-conductive state, the relay coil 16 closes the relay controlled switch 17 to energize the solenoid 20, causing the control valve 19 to open the bypass passage 18 so as to permit the engine to operate in the region of engine speed from 1100 to 3000 rpm.

The control circuit 6 may employ a digital computer which shall be regarded as including an analog-to-digital converter, a central processing unit, a memory, a timer, and a digital-to-analog converter. The analog-to-digital converter receives the analog signals V1 and V2 from the accelerator-pedal and throttle-valve position sensor 4 and 12 and converts the received signals into corresponding digital signals for application to the central processing unit. The memory contains the program for operating the central processing unit and further contains appropriate data in look-up tables used in calculating appropriate values for the position of the throttle valve 2 and determining a failure in the operation of the control circuit 6. The look-up data may be obtained experimentally or derived empirically. The central processing unit may be programmed in a known manner to interpolate between the data at different entry points if desired. Control words specifying a desired throttle valve position are periodically transferred by the central processing unit to the digital-to-analog converter. The digital-to-analog converter converts the transferred information into analog form and applies a control signal SC to the drive circuit 7 for controlling the direction and degree of motion of the control motor 11.

Figures 2, 3:
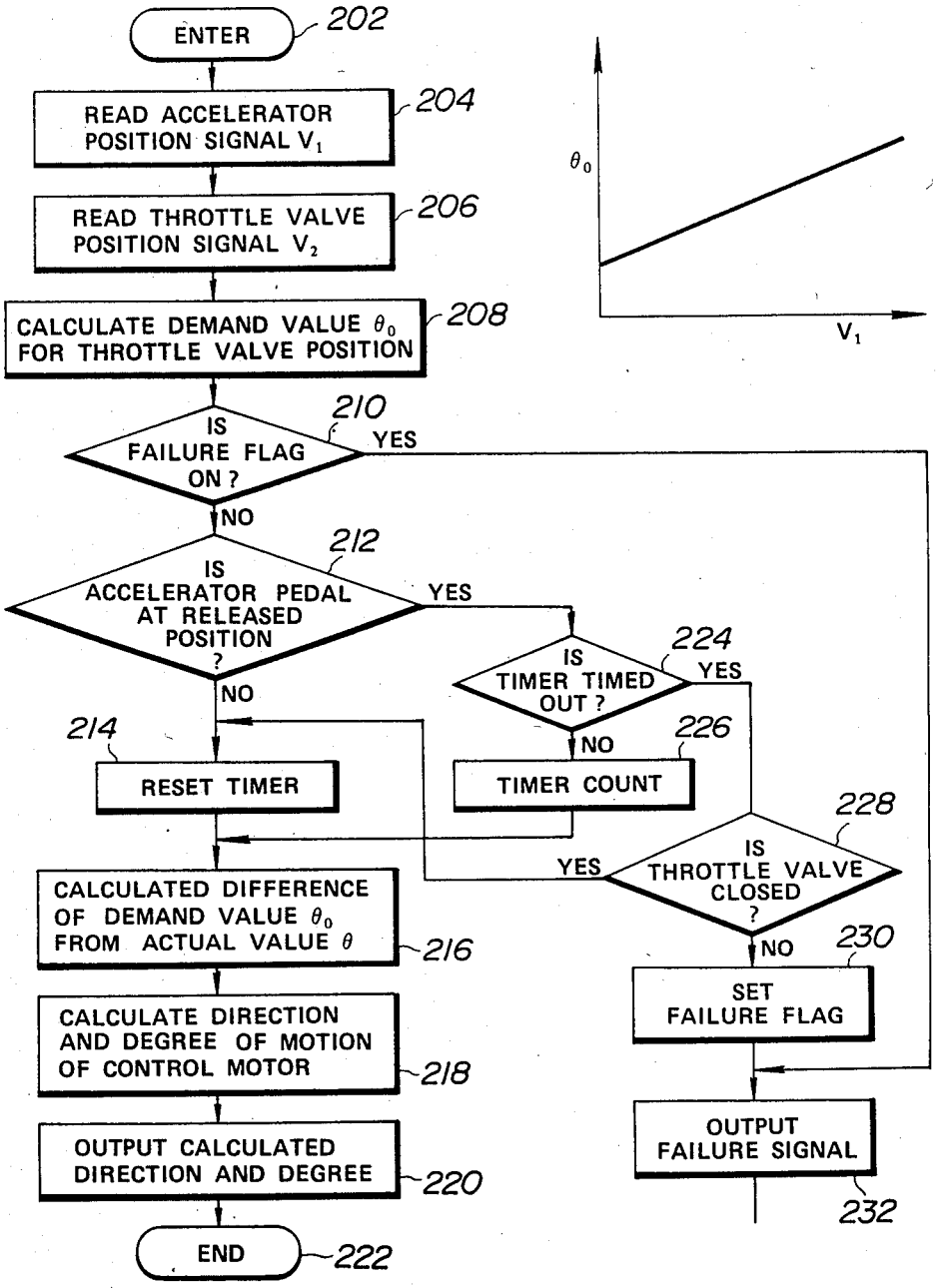
FIG. 2 is a flow diagram showing the programming of the digital computer used in the apparatus of FIG. 1.
FIG. 3 is a representation of values produced by the read only memory of the digital computer.

FIG. 2 is a flow diagram of the programming of the digital computer used in the control circuit 6. The computer program is entered at the point 202 at predetermined time intervals, or at appropriate times, or in synchronism with engine rotation. Following this, the accelerator-pedal and throttle-valve position signals V1 and V2 are, one by one, converted by the analog-to-digital converter into digital form. Thus, at the point 204 in the program, the accelerator pedal position signal V1 is converted to digital form and read into the computer memory. At the point 206, the throttle valve position signal V2 is converted to digital form and read into the computer memory. At the point 208, the central processing unit calculates a demand value $\theta o$ for the throttle valve position from a relationship pprogrammed into the computer. This relationship is shown in FIG. 3 and it defines throttle valve position demand value $\theta o$ as a function of throttle valve position signal V1.

At the 210 in the program, a determination is made as to whether or not a failure flag is preset. The failure flag indicates that a failure occurs during the operation of the control circuit 6 and it is set when the time the throttle valve remains open after the accelerator pedal moves to its fully released position exceeds a predetermined time, as described later. If the answer to this question is "yes", then the program proceeds to the point 232 where the central processing unit produces a command to interrupt application of power to the control motor 11 and also to generate a failure signal SF on the line 14 so as to switch the transistor 15 off. If the failure flag is not preset, then the program proceeds to another determination point 212. This determination is as to whether or not the accelerator pedal is at its fully released position. The determination is made in accordance with the read value of the accelerator pedal position signal V1. If the answer to this question is "no", then the program proceeds to the point 214 where the timer is reset to zero. The timer serves to measure the time during which the throttle valve remains open after the accelerator pedal is released.

At the point 216 in the program, the central processing unit calculates a difference $\epsilon$ of the throttle valve position actual value $\theta$ from the throttle valve position demand value $\theta o$. At the point 218, the central processing unit calculates the direction and degree of motion of the bi-directional control motor 11 required to bring the throttle valve to a new setting. The direction in which the control motor 11 is to rotate is determined as a first direction moving the throttle valve in an opening direction when the sign of the calculated difference $\epsilon$ is positive and as a second direction closing the throttle valve when the calculated difference $\epsilon$ is negative. The degree of motion of the control motor 11 is determined in direct proportion to the absolute value of the calculated difference. At the point 220, the calculated new setting information are transferred to the output control circuit which thereby produces a control signal SC to the drive circuit 7 for controlling the direction and degree of motion of the control motor. Following this, the program proceeds to the end point 222.

If the answer to the question inputted at the point 212 is "yes", then it means that the accelerator pedal is at its fully released position and the program proceeds to the determination point 224. This determination is as to whether or not the timer is timed out. If the answer to this question is "no", then the program proceeds to the point 226 where the timer is permitted to continue counting and then the program proceeds to the point 216. If the timer is timed out, then the program proceeds to the point 228 where a determination is made as to whether or not the throttle valve is closed. If the answer to this question is "yes", then the program proceeds to the point 214 where the timer is reset. Otherwise, the program proceeds to the point 230 where the failure flag is set to indicate that the throttle valve remains open for a time greater than the timer preset in the timer after the accelerator pedal returns to its fully released position. At the point 232, the central processing unit produces a command to inhibit application of power to the control motor 11 and also to generate a failure signal SF so as to turn the transistor 15 off. After the failure flag is set once, the failure signal SF is outputted repetitively since the program proceeds from the point 210 to the point 232 in each cycle of execution of the computer program.

While the control circuit 6 has been described as generating a failure signal SF when the throttle valve remains open for a time greater than a predetermined time after the accelerator pedal is released, it is to be noted that it may be arranged to produce the failure signal SF when the difference of the throttle valve position actual value $\theta$ from the throttle valve position demand value $\theta o$ exceeds a predetermined value in spite of the fact that the throttle valve 9 is at its fully open position. In addition, the control circuit 6 may be arranged to generate the failure signal SF in response to a reset signal produced from a runaway monitor circuit which monitors the program run signal and generates the reset signal in the event of failure of the execution of the program.

Figure 4:
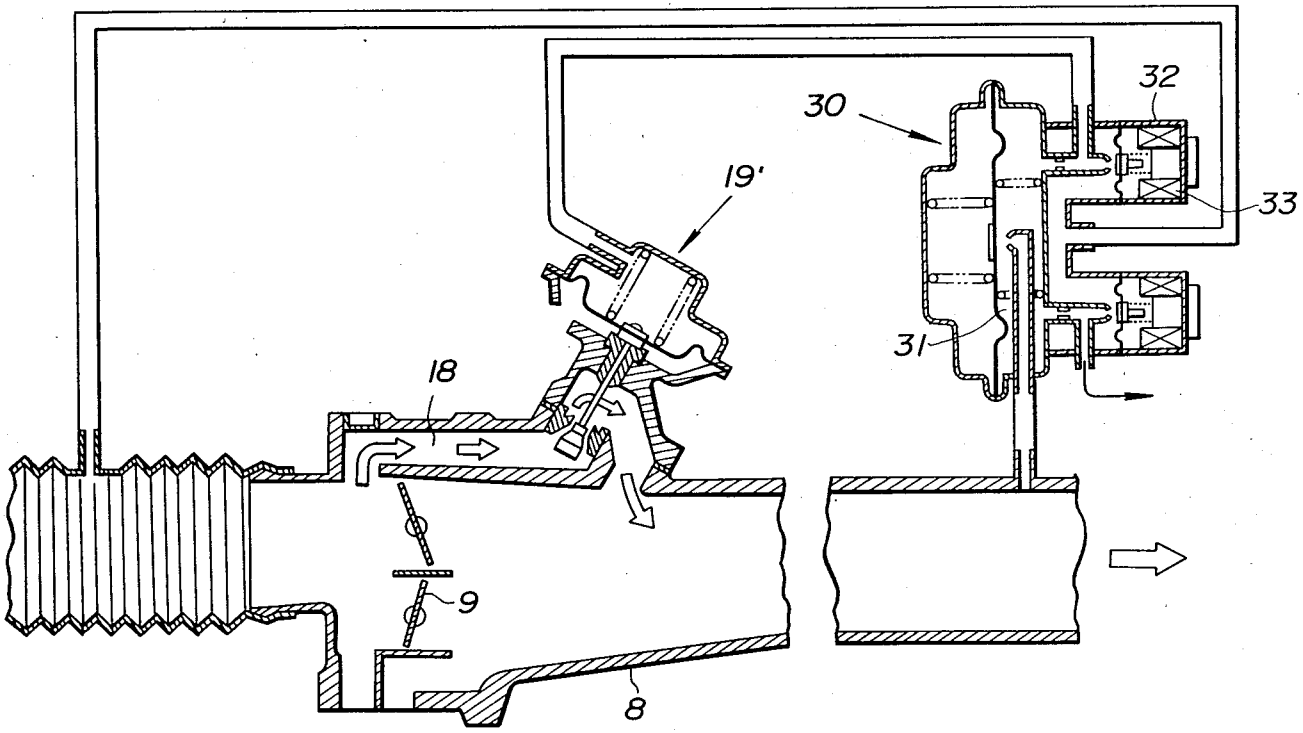
FIG. 4 is a schematic sectional view showing an idle speed control system.
Figure 5:
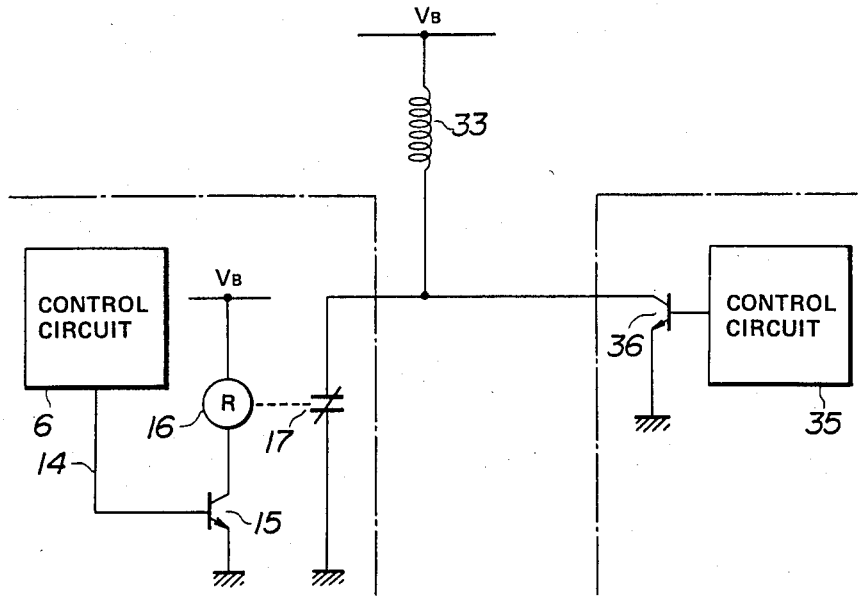
FIG. 5 is a block diagram showing a modified form of the first embodiment applied to the idle speed control system of FIG. 4.

Referring to FIGS. 4 and 5, there is illustrated a modified form of the throttle valve control system wherein the present invention is applied to an idle speed control system. As shown in FIG. 4, the idle speed control system includes an auxiliary or separated induction passage which acts as a bypass for the throttle valve 9 situated in he main induction passage 8. An idle air flow or auxiliary air control (AAC) valve 19' is situated in the auxiliary induction passage 18 for controlling the flow of air through the auxiliary induction passage 18 during idle engine operation. The auxiliary air control valve 19' operates in response to a negative pressure introduced from a vacuum control (VCM) valve 30. The vacuum control valve 30 has a vacuum chamber 31 into which a manifold negative pressure is introduced. The vacuum control valve 30 also includes a solenoid valve 32 which controls the degree of atmospheric pressure to be introduced into the vacuum chamber 31 to control the pressure in he vacuum chamber 31 in accordance with the duty ratio of a pulse signal applied to its solenoid 33. The negative pressure controlled in the vacuum chamber 31 is applied to the auxiliary air control valve 19'. The auxiliary air control valve 19' adjusts the effective area of the auxiliary induction passage 18 to control the idle engine speed in accordance with the duty ratio or duty cycle of the pulse signal applied to the solenoid 33. The amount of air permitted to flow through the auxiliary induction passage 18 increases as the duty ratio of the pulse signal applied to the solenoid 33 increases.

As shown in FIG. 5, the solenoid 33 has a terminal connected to the voltage source VB. The other terminal of the solenoid 33 is connected to electrical ground through the relay controlled switch 17 and also through the emitter-collector circuit of a transistor 36. The base electrode of the transistor 36 is connected to a main control circuit 35 which is used to control the engine. The main control circuit 5 switches the transistor 36 on and off to energize the solenoid 33 at a duty ratio required to adjust the auxiliary air control valve 19' at a position providing a desired engine idle speed corresponding to the duty ratio.

Upon detection of a failure in the control circuit 6, the control circuit 6 generates a failure signal SF on the line 14 to switch the transistor 15 off. This in turn deenergizes the relay coil 16 to close the relay controlled switch 17 so as to connect the solenoid 33 to electrical ground. As a result, the auxiliary air control valve 19' moves to its fully open position at which the amount of air permitted to flow through the auxiliary induction passage 18 is at maximum so that the engine can operate in the region of engine idle speed from 1100 to 3000 rpm, permitting the automotive vehicle to run to a place suitable for repair.

Figure 6:
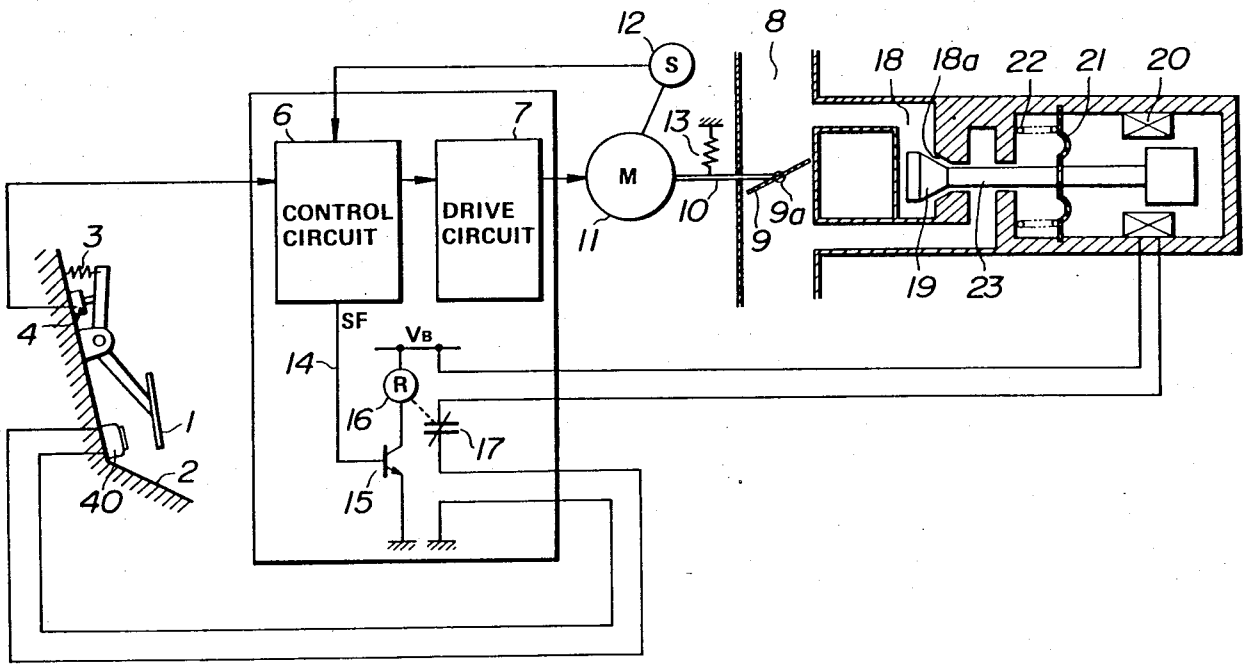
FIG. 6 is a schematic diagram showing a second embodiment of the present invention.

Referring to FIG. 6, there is illustrated a second embodiment of the present invention which differs from the first embodiment only in that an accelerator-pedal operated controller is provided in series with the relay controlled switch 17. The accelerator-pedal operated controller is shown as an accelerator-pedal operated switch 40 mounted on the floor panel 2 at a position facing to the accelerator pedal 1. The accelerator-pedal operated switch 40 is turned on to connect the relay controlled switch 17 to electrical ground when the accelerator pedal 1 is depressed to an amount greater than a predetermined value.

In the event of failure of the control circuit 6, the control circuit 6 generates a failure signal SF on the line 14 to switch the transistor 15 off. This in turn deenergizes the relay coil 16 to cose the relay controlled switch 17. However, until the accelerator pedal 1 is depressed to the predeermined amount, the accelerator-pedal operated switch 40 remains open. As a result, the solenoid 20 remains deenergized to close the auxiliary air control valve 19 so as to block the air flow through the auxiliary air passage 18. When the operator notices the failure and depresses the accelerator pedal to the predetermined amount, the accelerator-pedal operated switch 40 is turned on to connect the solenoid 22 to electrical ground. As a result, the auxiliary air control valve 19 opens to allow air flow through the auxiliary air passage 18 so as to increase the engine speed. According to this embodiment, the operator may operate the accelerator pedal 1 in a manner to switch the accelerator-pedal operated switch 40 on and off to have a fine engine speed control and improve the drivability in the event of failure of the control circuit 6.

Figure 7:
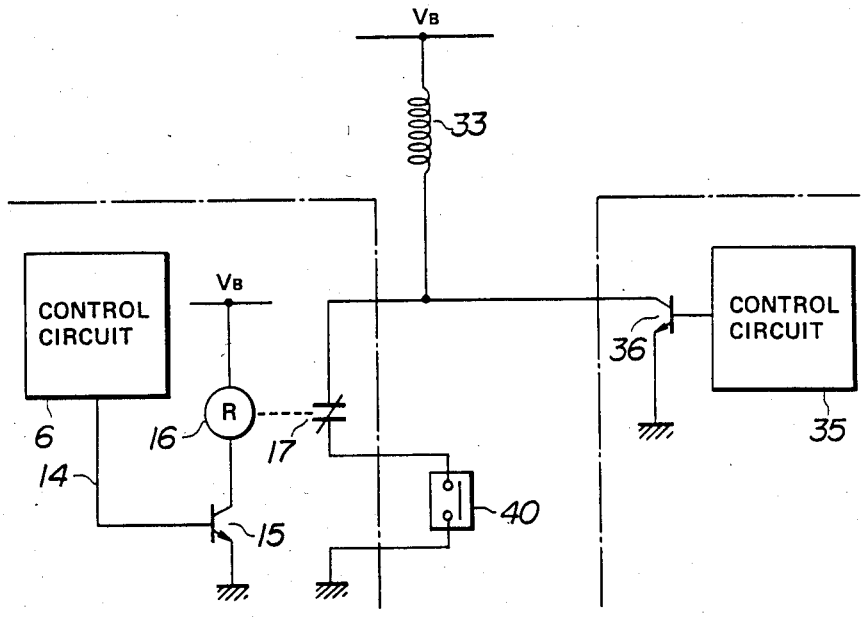
FIG. 7 is a schematic diagram showing a modified form of the second embodiment applied to the idle speed control system of FIG. 4.

Referring to FIG. 7, there is illustrated a modified form of the second embodiment where the present invention is applied to an idle speed control system as shown and described in connection with FIG. 4. As shown in FIG. 7, the solenoid 33 has a terminal connected to the voltage source VB. The other terminal of the solenoid 33 is connected to electrical ground through a series connection of the relay controlled switch 17 and the accelerator-pedal operated switch 40 and also through the emitter-collector circuit of a transistor 36. The base electrode of the transistor 36 is connected to a main control circuit 35 which is used to control the engine. The main control circuit 35 switches the transistor 35 on and off to energize the solenoid 33 at a duty ratio required to adjust the auxiliary air control valve 19' at a position providing a desired engine idle speed corresponding to the duty ratio.

Upon detection of a failure in the control circuit 6, the control circuit 6 generates a failure signal SF on the line 14 to switch the transistor 15 off. This in turn deenergizes the delay coil 16 to close the delay controlled switch 17. However, until the accelerator pedal 1 is depressed to an amount greater than the predetermined value, the accelerator-pedal operated switch 40 remains open. As a result, the solenoid 33 remains deenergized to close the auxiliary air control valve 19' so as to block the air flow through the auxiliary induction passage 18. When the operator notices the failure and depresses the accelerator pedal 1 to the predetermined amount, the accelerator-pedal operated switch 40 turns on to connect the solenoid 33 to electrical ground. As a result, the auxiliary air control valve 19' opens to allow air flow through the auxiliary induction passage 18 so as to increase the engine speed.

While the second embodiment has been described in connection with an accelerator-pedal operated controller taken in the form of an accelerator-pedal operated switch adapted to turn on when the accelerator pedal is depressed to an amount greater than a predetermined value, it is to be understood that the accelerator-pedal operated controller may be arranged to switch the switch 40 on and off at a duty ratio or duty cycle steppedly or steplessly increasing as the amount of depression of the accelerator pedal 1 increases. In this case, the accelerator-pedal operated controller may use the accelerator pedal position sensor 4 in common with the control circuit 6 to detect the amount of depression of the accelerator pedal 1.

The bi-directional control motor is in no way limited to a DC servo motor. For example, the control motor may be a stepper motor if desired in which case the control circuit may be arranged to determine the direction in which the stepper motor is to rotate based upon the sign of the difference $\epsilon$ of the throttle valve position actual value $\theta$ from the throttle valve position demand value $\theta o$ and the step number by which the stepper motor is to rotate based upon the absolute value of the difference $\epsilon$.

While the present invention has been described in conjunction with specific embodiments thereof, it is evident that many alternatives, modifications and variations will be apparent to those skilled in the art. Accordingly, it is intended to embrace all alternatives, modifications and variations that fall within the scope of the appended claims.

What is claimed is:

1. An apparatus for use with an internal combustion engine having an accelerator pedal and a throttle valve situated within an induction passage for controlling movement of said throttle valve in response to a change in the position of said accelerator pedal, comprising:

said induction passage having an auxiliary passage bypassing said throttle valve;

a control valve movable within said auxiliary passage for controlling air flow through said auxiliary passage;

a signal source for generating an electrical signal indicative of the position of said accelerator pedal;

a control circuit operable to determine a value corresponding to a setting of the position of said throttle valve in response to said accelerator pedal position indicative signal;

a throttle actuator connected to said control circuit for moving said throttle valve to said determined setting; and said control circuit including means for forcing said throttle actuator to close said throttle valve and moving said control valve to a predetermined open position to permit air flow through said auxiliary passage when a failure occurs in the operation of said control circuit.

2. The apparatus as claimed in claim 1, wherein said control circuit includes means for controlling the movement of said control valve in accordance with the amount of depression of said throttle valve.

3. The apparatus as claimed in claim 2, wherein said control circuit includes means for retaining said control valve at a position blocking the air flow through said auxiliary passage until said accelerator pedal is depressed to an amount greater than a predetermined value.

4. The apparatus as claimed in claim 1, wherein said control valve includes a valve element movable within said auxiliary passage between an open position and a closed position, and a valve actuator operable to move said valve element to the open position to permit air flow through said auxiliary passage when connected to a voltage source, said valve actuator retaining said valve element at the closed position to block the air flow through said auxiliary passage when disconnected from said voltage source, and wherein said control means includes a first switch which closes to connect said valve actuator to said voltage source when a failure occurs in the operation of said control circuit.

5. The apparatus as claimed in claim 4, wherein said control circuit includes a second switch connected in series with said first switch, said second switch closing only when said accelerator pedal is depressed to an amount greater than a predetermined value.

6. The apparatus as claimed in claim 1, wherein said control valve includes a valve element movable within said auxiliary passage between an open position and a closed position, and a valve actuator operable to move said valve element to the open position to permit air flow through said auxiliary passage when connected to a voltage source, said valve actuator retaining said valve element at the closed position to block the air flow through said auxiliary passage when disconnected from said voltage source, and wherein said control means includes a first switch operable between an on state and an off state, said first switch connecting said valve actuator to said voltage source at the on state, said first switch disconecting said valve actuator from said voltage source at the off state, means for switching said first switch on and off at a duty cycle to control engine speed during said engine being idling, and a second switch connected in parallel with said first switch for closing to connect said valve actuator to said voltage source when a failure occurs in the operation of said control circuit.

* * * * *